US008902152B2

(12) United States Patent
Bai et al.

(10) Patent No.: US 8,902,152 B2
(45) Date of Patent: Dec. 2, 2014

(54) DUAL SIDED ELECTROPHORETIC DISPLAY

(75) Inventors: XiaoPing Bai, Lake Zurich, IL (US); John P. Boos, Grayslake, IL (US); Bharat N. Vakil, Coral Springs, FL (US); Zhiming Zhuang, Kildeer, IL (US)

(73) Assignee: Motorola Mobility LLC, Libertyville, IL (US)

( * ) Notice: Subject to any disclaimer, the term of this patent is extended or adjusted under 35 U.S.C. 154(b) by 2225 days.

(21) Appl. No.: 11/741,877

(22) Filed: Apr. 30, 2007

(65) Prior Publication Data

US 2008/0266244 A1 Oct. 30, 2008

(51) Int. Cl.
*G09G 3/34* (2006.01)

(52) U.S. Cl.
USPC ..... 345/107; 345/204; 359/237; 359/296

(58) Field of Classification Search
USPC ..... 345/1.1, 107, 204
See application file for complete search history.

(56) References Cited

U.S. PATENT DOCUMENTS

| | | | |
|---|---|---|---|
| 3,915,548 | A | 10/1975 | Opittek et al. |
| 4,017,848 | A | 4/1977 | Tannas, Jr. |
| 4,078,257 | A | 3/1978 | Bagley |
| 4,422,721 | A | 12/1983 | Hahn et al. |
| 4,462,924 | A | 7/1984 | Raynes |
| 4,500,173 | A | 2/1985 | Leibowitz et al. |
| 4,545,648 | A | 10/1985 | Shulman et al. |
| 4,728,936 | A | 3/1988 | Guscott et al. |
| 4,893,903 | A | 1/1990 | Thakar et al. |
| 5,121,234 | A | 6/1992 | Kucera |
| 5,225,818 | A | 7/1993 | Lee et al. |
| 5,231,381 | A | 7/1993 | Duwaer |
| 5,376,948 | A | 12/1994 | Roberts |
| 5,600,459 | A | 2/1997 | Roy et al. |
| 5,796,454 | A | 8/1998 | Ma |

(Continued)

FOREIGN PATENT DOCUMENTS

| | | |
|---|---|---|
| EP | 1341029 | 9/2003 |
| EP | 1467536 B1 | 10/2004 |

(Continued)

OTHER PUBLICATIONS http://en.wikipedia.org/wiki/Liquid_crystal_display.

(Continued)

*Primary Examiner* — Grant Sitta

(57) ABSTRACT

A dual-sided electrophoretic display (700) having a first region (701) and a second region (702) is provided. Each of the first region (701) and the second region (702) includes selectively operable members (703,704) that function as pixels for presenting images on the electrophoretic display (700). Each of the selectively operable members (703,704) is driven by a driver circuit (710) by way of corresponding thin film transistors and capacitors (742,742), which are opaque. As the selectively operable members (704) of the second region (702) are bigger than are the selectively operable members (703) of the first region (701), the aperture ratio of the selectively operable members (704) of the second region (702) is greater than in the first region (701) when viewed from the rear side (730). Thus, a contrast ratio of the second region (602), when viewed from the rear side (730) is sufficiently high that text, icons, and characters presented in the second region (602) are legibly visible on the rear side (730).

6 Claims, 12 Drawing Sheets

(56) References Cited

U.S. PATENT DOCUMENTS

| | | | | |
|---|---|---|---|---|
| 5,818,615 | A | 10/1998 | Abileah et al. | |
| 6,047,196 | A | 4/2000 | Veli-Matti et al. | |
| 6,058,164 | A | 5/2000 | Ibuka et al. | |
| 6,103,384 | A | 8/2000 | Mario | |
| 6,144,359 | A | 11/2000 | Grave | |
| 6,150,962 | A | 11/2000 | Rossmann | |
| 6,188,379 | B1 | 2/2001 | Kaneko | |
| 6,211,931 | B1 | 4/2001 | Fukao et al. | |
| 6,243,080 | B1 | 6/2001 | Molne | |
| 6,271,835 | B1 | 8/2001 | Hoeksma | |
| 6,310,609 | B1 | 10/2001 | Morgenthaler | |
| 6,327,376 | B1 | 12/2001 | Harkin | |
| 6,470,196 | B1 | 10/2002 | Yamashita | |
| 6,574,044 | B1 | 6/2003 | Sahouani et al. | |
| 6,574,487 | B1 | 6/2003 | Smith et al. | |
| 6,646,697 | B1 | 11/2003 | Sekiguchi et al. | |
| 6,662,244 | B1 | 12/2003 | Takahashi | |
| 6,704,004 | B1 | 3/2004 | Ostergard et al. | |
| 6,768,481 | B2 | 7/2004 | Ozawa et al. | |
| 6,768,586 | B2 | 7/2004 | Sahouani et al. | |
| 6,813,957 | B1 | 11/2004 | Platz | |
| 6,819,316 | B2 | 11/2004 | Schulz et al. | |
| 6,819,380 | B2 | 11/2004 | Wen et al. | |
| 6,842,170 | B1 | 1/2005 | Akins et al. | |
| 6,864,945 | B2 | 3/2005 | Fujimori et al. | |
| 6,914,874 | B2 | 7/2005 | Kondo | |
| 6,968,744 | B1 | 11/2005 | Silverbrook et al. | |
| 7,106,517 | B2 | 9/2006 | Olczak | |
| 7,123,945 | B2 * | 10/2006 | Kokubo | 455/566 |
| 7,127,705 | B2 | 10/2006 | Christfort et al. | |
| 7,139,114 | B2 | 11/2006 | Schmitz et al. | |
| 7,180,672 | B2 | 2/2007 | Olczak | |
| 7,345,671 | B2 | 3/2008 | Robbin et al. | |
| 2002/0090980 | A1 | 7/2002 | Wilcox et al. | |
| 2003/0020999 | A1 | 1/2003 | Tsujimura et al. | |
| 2003/0025679 | A1 | 2/2003 | Taylor et al. | |
| 2003/0054867 | A1 | 3/2003 | Dowlat et al. | |
| 2003/0058223 | A1 | 3/2003 | Tracy et al. | |
| 2003/0161093 | A1 | 8/2003 | Lam et al. | |
| 2004/0036680 | A1 | 2/2004 | Davis et al. | |
| 2004/0058718 | A1 | 3/2004 | Yu | |
| 2004/0092196 | A1 | 5/2004 | Van De Witte et al. | |
| 2004/0104826 | A1 | 6/2004 | Philipp | |
| 2004/0189591 | A1 | 9/2004 | Breuil | |
| 2004/0218121 | A1 | 11/2004 | Zhuang et al. | |
| 2004/0246580 | A1 | 12/2004 | Sahouani et al. | |
| 2004/0265602 | A1 | 12/2004 | Kobayashi et al. | |
| 2005/0007339 | A1 | 1/2005 | Sato | |
| 2005/0020316 | A1 | 1/2005 | Mahini | |
| 2005/0020325 | A1 | 1/2005 | Enger et al. | |
| 2005/0030048 | A1 | 2/2005 | Bolender et al. | |
| 2005/0030292 | A1 | 2/2005 | Diederiks | |
| 2005/0064913 | A1 | 3/2005 | Kim | |
| 2005/0088417 | A1 | 4/2005 | Mulligan | |
| 2005/0093767 | A1 * | 5/2005 | Lu et al. | 345/1.1 |
| 2005/0114825 | A1 | 5/2005 | Leung et al. | |
| 2005/0134549 | A1 * | 6/2005 | Kamiya et al. | 345/103 |
| 2005/0243069 | A1 | 11/2005 | Yorio et al. | |
| 2005/0264190 | A1 | 12/2005 | Park et al. | |
| 2005/0266891 | A1 | 12/2005 | Mullen | |
| 2006/0026535 | A1 | 2/2006 | Hotelling et al. | |
| 2006/0038937 | A1 | 2/2006 | Kaneko et al. | |
| 2006/0046792 | A1 | 3/2006 | Hassemer et al. | |
| 2006/0146012 | A1 | 7/2006 | Arneson et al. | |
| 2006/0161870 | A1 | 7/2006 | Hotelling et al. | |
| 2006/0161871 | A1 | 7/2006 | Hotelling et al. | |
| 2006/0166702 | A1 | 7/2006 | Dietz et al. | |
| 2006/0197753 | A1 | 9/2006 | Hotelling | |
| 2006/0266640 | A1 | 11/2006 | Halsey et al. | |
| 2006/0277472 | A1 | 12/2006 | Yodo et al. | |
| 2006/0290871 | A1 | 12/2006 | Harada | |
| 2007/0030438 | A1 | 2/2007 | Chiang | |
| 2007/0052689 | A1 | 3/2007 | Tak | |
| 2007/0075965 | A1 | 4/2007 | Huppi et al. | |
| 2007/0097595 | A1 | 5/2007 | Radivojevic et al. | |
| 2007/0152983 | A1 | 7/2007 | McKillop et al. | |
| 2007/0164986 | A1 | 7/2007 | Jeong et al. | |
| 2007/0273662 | A1 | 11/2007 | Lian et al. | |
| 2008/0122796 | A1 | 5/2008 | Jobs et al. | |
| 2008/0169944 | A1 | 7/2008 | Howarth et al. | |
| 2008/0204417 | A1 | 8/2008 | Pierce et al. | |
| 2008/0204463 | A1 | 8/2008 | Cybart et al. | |
| 2008/0211734 | A1 | 9/2008 | Huitema et al. | |
| 2008/0309589 | A1 | 12/2008 | Morales | |
| 2008/0316397 | A1 | 12/2008 | Polak et al. | |

FOREIGN PATENT DOCUMENTS

| | | | |
|---|---|---|---|
| GB | 2348039 | | 9/2000 |
| GB | 2359178 | A | 8/2001 |
| JP | 03-180920 | | 8/1991 |
| JP | 08-063271 | | 3/1996 |
| JP | 2002-049461 | | 2/2002 |
| JP | 2003-101622 | | 4/2003 |
| JP | 2005-100186 | | 4/2005 |
| JP | 2005352987 | A | 12/2005 |
| JP | 2006-091486 | A | 4/2006 |
| JP | 2006-243658 | A | 9/2006 |
| JP | 2006-2874757 | A | 10/2006 |
| KR | 10-1998-0026397 | | 7/1998 |
| KR | 20-0225646 | | 6/2001 |
| KR | 10-2004-0019677 | | 3/2004 |
| KR | 100652767 | | 11/2006 |
| KR | 10-2006-0134659 | | 12/2006 |
| KR | 10-2007-0109603 | | 11/2007 |
| WO | WO-01/13209 | | 2/2001 |
| WO | WO 02/31807 | | 4/2002 |
| WO | WO-03-104884 | A2 | 12/2003 |
| WO | WO-2006/094308 | | 9/2006 |
| WO | 2006116145 | A2 | 11/2006 |
| WO | 2006123294 | A2 | 11/2006 |
| WO | WO-2007/063809 | A1 | 6/2007 |

OTHER PUBLICATIONS

""Palm Treo 650 Cell Phone" (Lets Talk catalog web site as of 2006)", http://web.archive.org/web/20060313154345/www.letstalk.com/product/product.htm?prid=27762.

Tsvey, Gennadiy "Non-Final Office Action", U.S. Appl. No. 11/684,454, mailed Nov. 9, 2009.

Tsvey, Gennadiy "Non-Final Office Action", U.S. Appl. No. 11/684,476, mailed Oct. 9, 2009.

Joseph, Dennis P., "Non-Final Office Action Mailed Nov. 13, 2009", U.S. Appl. No. 11/679,233, filed Feb. 27, 2007, First Inventor Adam Cybart.

Walthall, Allison N., "Non-Final Office Action", U.S. Appl. No. 11/766,921, filed Jun. 22, 2007, Mailed Jan. 27, 2010.

Schnirel, Andrew B., "Non-Final Office Action", U.S. Appl. No. 11/679,228, filed Feb. 27, 2007, Adam Cybart, inventor, Mailed Mar. 10, 2010.

United States Patent and Trademark Office, "Non-Final Rejection" for U.S. Appl. No. 11/762,481 dated May 14, 2010, 16 pages.

United States Patent and Trademark Office, "Non-Final Rejection" for U.S. Appl. No. 11/959,999 dated Aug. 4, 2011, 06 pages.

European Patent Office, "Extend European Search Report" for European Patent Application No. 08728978.1 dated May 11, 2010, 8 pages.

United States Patent and Trademark Office, "Non-Final Rejection" for U.S. Appl. No. 11/684,476 dated May 25, 2010, 29 pages.

NPL: segmented. (n. d.). The American Heritage® Dictionary of the English Language, Fourth Edition. Retrieved May 20, 2010, from Dictionary.com website: http://dictionary.reference.com/browse/segemented.

United States Patent and Trademark Office, "Non-Final Rejection" for U.S. Appl. No. 11/751,175 dated May 19, 2010, 21 pages.

United States Patent and Trademark Office, "Non-Final Rejection" for U.S. Appl. No. 11/679,233 dated Feb. 2, 2011, 14 pages.

Engadget, Pioneer unveils Inno XM2go portable XM radio/MP3 player, downloaded Aug. 9, 2007, 23 pages. http://www.engadget.com/2006/01/04/pioneer-unveils-inno-xm2go-portable-xm-radio-mp3-player/.

(56) References Cited

OTHER PUBLICATIONS

Apple, iTunes for your Mobile Phone, downloaded Aug. 9, 2007, 2 pages. http://www.apple.com/itunes/mobile.
Mobiledia, "Samsung T509 Phone" downloaded Aug. 9, 2007, 10 pages. http://www.mobiledia.com/phones/samsung/sgh-t509.html.
United States Patent and Trademark Office, "Non-Final Rejection" for U.S. Appl. No. 11/836,616 dated Nov. 23, 2010, 12 pages.
United States Patent and Trademark Office, "Non-Final Rejection" for U.S. Appl. No. 11/836,973 dated Aug. 17, 2010, 21 pages.
Sony, Operation Guide PRS-500 Portable Reader System, 2006, Sony Coproration, pp. 1-82.
United States Patent and Trademark Office, "Final Rejection" for U.S. Appl. No. 11/836,973 dated Dec. 23, 2010, 20 pages.
Patent Cooperation Treaty, "PCT Search Report and Written Opinion of the International Searching Authority" for International Application No. PCT/US2008/071674 Jan. 4, 2011, 15 pages.
United States Patent and Trademark Office, "Notice of Allowance and Fee(s) Due" U.S. Appl. No. 11/838,061 dated Apr. 11, 2011, 09 pages.
United States Patent and Trademark Office, "Notice of Allowance and Fee(s) Due" U.S. Appl. No. 11/838,061 dated Aug. 9, 2011, 10 pages.
3M United States, Prism Films Tutorial, downloaded May 1, 2007, 1 page. http://cms.3m.com/cms/US/en/2-136/cRFFkFN/view.jhtml.
United States Patent and Trademark Office, "Non-Final Rejection" for U.S. Appl. No. 12/470,957 dated Apr. 17, 2012, 15 pages.

* cited by examiner

DUAL SIDED ELECTROPHORETIC DISPLAY

BACKGROUND

1. Technical Field

This invention relates generally to displays for electronic devices, and more particularly to an electrophoretic display that has a front-side and back-side contrast ratio sufficient to be viewable by a user.

2. Background Art

The popularity of mobile telephones and other electronic devices, including computers, personal digital assistants (PDA), electronic games, and similar devices has increased the importance of components used to manufacture these products. As these devices have grown in popularity, consumers are demanding increased functionality in each device. For example, while mobile telephones once only made telephone calls, modern devices now take pictures, play music and video, and even games. At the same time, retail prices of these devices have continued to decrease, due in part to competition and market pressure. Manufacturers thus face a quandary: how to deliver devices with more functionality at a lower overall cost. To help resolve this problem, device manufacturers frequently demand reduction in the prices of components used to build the device. One component of particular interest is the display, due to its cost relative to the cost of the overall device. Device manufacturers are desirous of a low-cost, highly visible and easily configurable display technology.

A new type of display that has recently been developed is the electrophoretic display. Electrophoretic displays are manufactured by suspending particles in a medium, examples of which include gas, liquid, or gel, between two substrates. The particles may optionally be encapsulated in small capsules that are held between the walls, or they may be emulsified in a polymeric matrix. The particles have optical properties that are different from the medium in which they are suspended. Due to the electrochemical properties of the particles, and of the medium, the particles spontaneously acquire a net charge when placed in the medium. Having a charge, the particles will move in the presence of an externally applied electric field. Transparent electrodes, often in the shape of pixels, apply selective electric fields to the particles, thereby causing the particles to rotate and move to the viewable display surface. This movement causes an image to appear at the viewable display surface. Electrophoretic displays tend to be both very efficient in terms of electrical current consumption. Further they are generally available at a reasonable cost.

Certain mobile devices, including some mobile telephones, employ multiple displays to present information to a user. For example, a flip-style mobile telephone may include a first, small display on the outside of the device to present status information including phone signal strength, battery power indications, and caller identification information. A second, larger display is then provided inside the flip for viewing pictures, phone lists, text messages and the like.

One problem associated with conventional electrophoretic displays is that they are legibly visible only from one side. As such, devices employing multiple displays require multiple electrophoretic displays. This duplicity of components increases the overall cost of the device.

There is thus a need for a single, electrophoretic display capable of being used in devices having more than one display.

Figure 1:
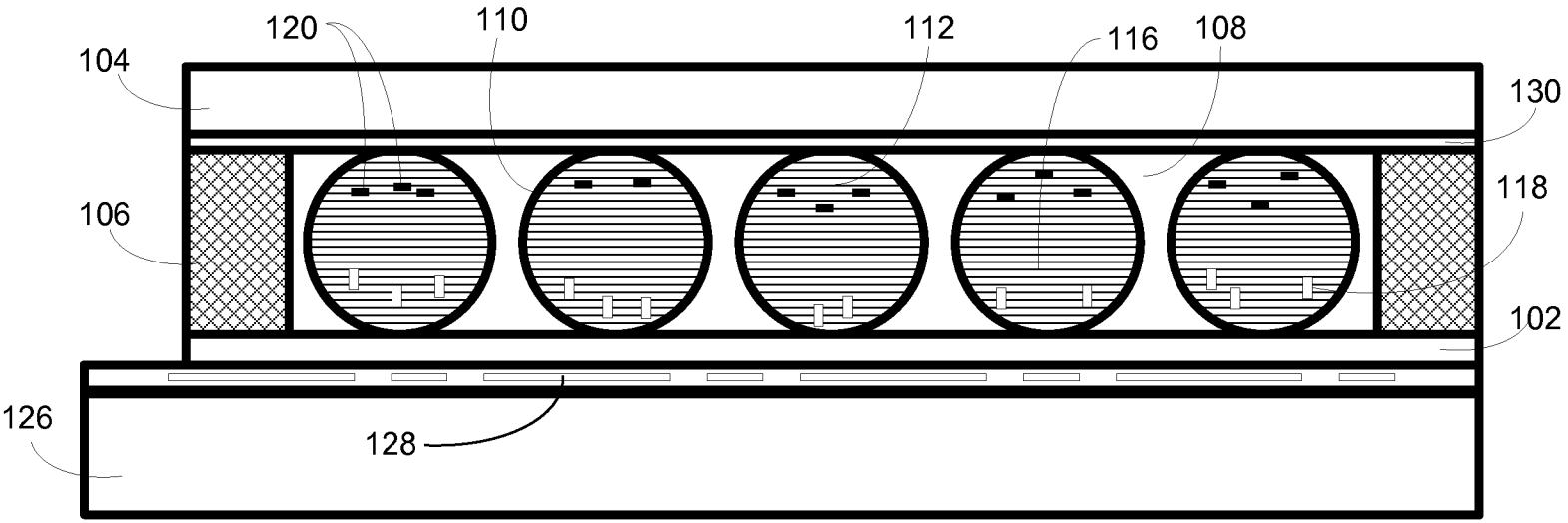
FIG. 1 (Prior Art)
FIG. 1 illustrates exemplary molecules of an electrophoretic display.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE INVENTION

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A. It is expected that one of ordinary skill, notwithstanding possibly significant effort and many design choices motivated by, for example, available time, current technology, and economic considerations, when guided by the concepts and principles disclosed herein will be readily capable of generating common components with minimal experimentation.

Turning now to FIG. 1, illustrated therein is a sectional view of an electrophoretic display 100. This conventional electrophoretic display includes a lamination adhesive 102 coupling a thin film transistor backplane 126 and a transparent front substrate 104. An adhesive 106 is generally employed to bond and seal the perimeters of the lamination adhesive 102 and the front substrate 104, thereby forming a chamber 108. While the exemplary electrophoretic display of FIG. 1 is one example of electrophoretic display technology useful for the discussion of embodiments of the invention herein, it will be clear to those of ordinary skill in the art having the benefit of this disclosure that the invention is not limited to this one type of display. Embodiments of the invention are suitable for any display material operating by moving particles electrophoretically, including those using gels, powders, gasses, or other transfer media for the colored particles disposed therein.

Referring again to the exemplary embodiment of FIG. 1, a plurality of capsules 110,112 is disposed within in the chamber 108. Each of the capsules 110,112 encloses a medium 116, such as hydrocarbon oil in liquid based electrophoretic materials, with light and dark particles 118,120 suspended therein. Some of these particles 118, which may be made from titanium dioxide, are generally white (i.e. reflective across the visible spectrum). Other particles 120 may be pigmented with a dark colored dye so as to appear black. With surfactants and charging agents, the white particles 118 are positively charged while the black particles 120 are negatively charged.

The front substrate 104 is a transparent substrate that is tied electrically to ground or a common node by a layer of transparent electrode material 130. When an electric field is applied to electrodes 128 disposed along the back substrate, the particles 118,120 migrate electrophoretically so as to form an image viewable to the user. For example, when the white particles 118 move to the top of the capsule 110 they become visible as the color white to the user from the front side. At the same time, the electric field pulls the black particles 120 to the bottom of the capsules 110 where they are hidden. By reversing this process, the black particles 120 appear at the top of the capsule 110, which becomes visible as the color black.

As mentioned above, manufacturers of electronic devices would like to have an electrophoretic display that is visible from both sides. While conventional electrophoretic displays include only one transparent substrate, one solution to provide such a dual-sided display is to use two transparent substrates, one on each side of the display. A transparent electrode material, such as indium-tin oxide (In.sub.2 O.sub.3-SnO.sub.2) may then be used to render both sides of the display visible. There is, however, an inherent problem with this solution. The problem involves the aperture ratio that will be discussed in more detail below.

Figure 2:
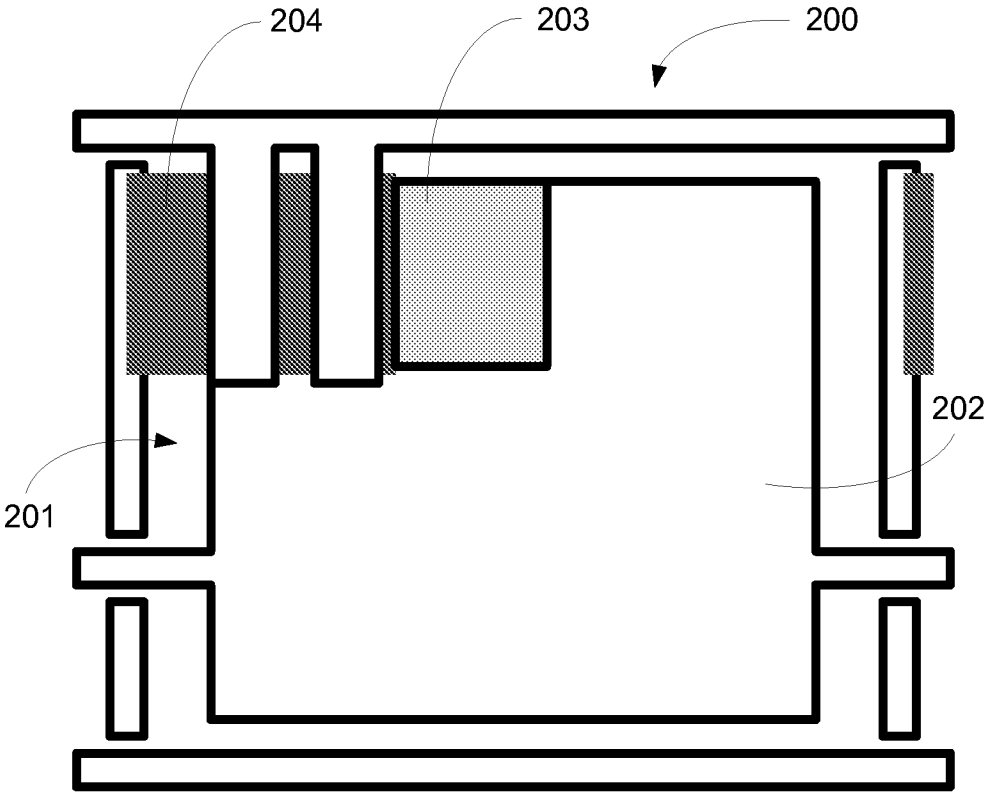
FIG. 2 illustrates an electrophoretic pixel associated with conventional electrophoretic display devices.

Turning now to FIG. 2, illustrated therein is a rear, plan view of a pixel 200 in an electrophoretic display having a transparent rear substrate 201 and an indium-tin oxide electrode 202 disposed thereon. To properly apply an electric field to move the particles in the electrophoretic display, additional components are required. These additional components include a thin film transistor 203 and a capacitor 204. The capacitor 204 stores a charge sufficient to induce the electric field along the electrode 201, and the thin film transistor 203 regulates when the capacitor 204 charges and discharges.

While the indium-tin oxide electrode 202 is transparent, the thin film transistor 203 and the capacitor 204 are not. They are generally manufactured from deposited metal and are thus opaque. As these components are disposed on the back substrate 201, they effectively "block out" the color presented by the particles in the display. Thus, for a pixel with area x, using a capacitor and thin film transistor having an area y, only (x−y)/x of the pixel is viewable from the rear side of the display. By way of example, for a typical 100-pixel-per-inch electrophoretic display, the thin film transistor 203 and capacitor 204 may block as much as 35-40% of the overall area of the pixel.

Figure 3:
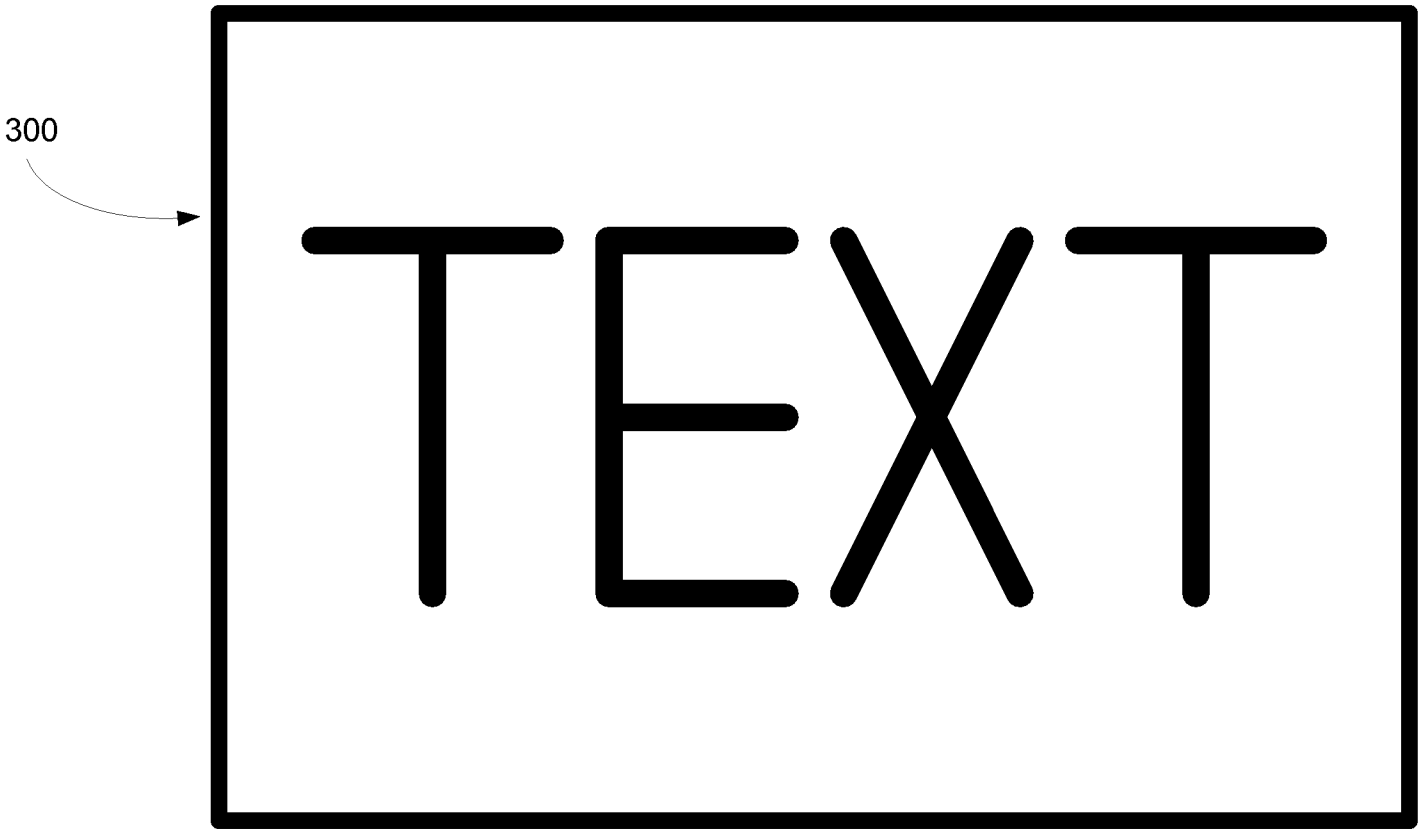
FIG. 3 illustrates a front, plan view of a conventional electrophoretic display.
Figure 4:
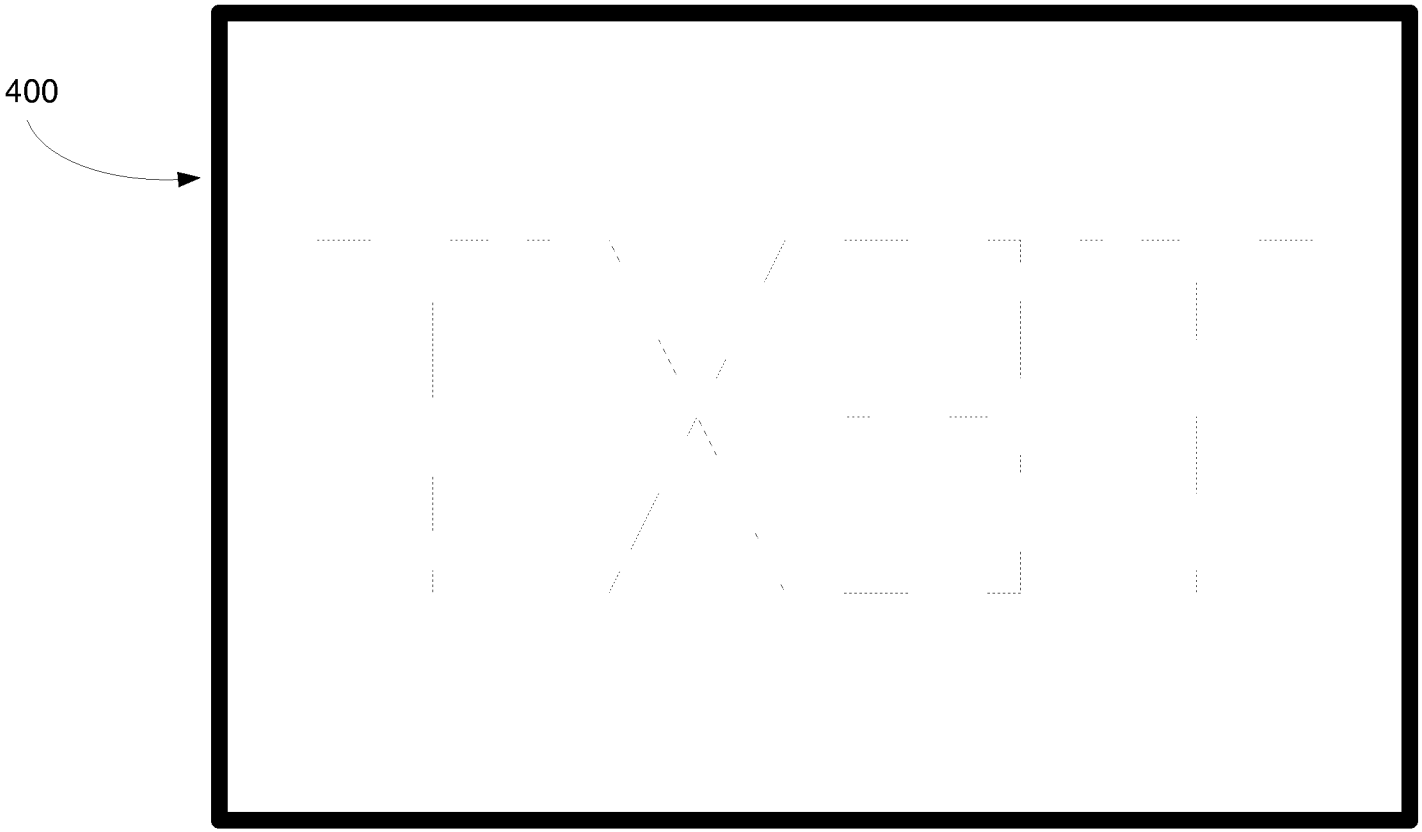
FIG. 4 illustrates a rear, plan view of an electrophoretic display having a transparent rear substrate.

The net result is that a substantially reduced area of the pixel is viewable from the back side of the display. This substantially reduced area results in a view that looks fuzzy, grainy, non-existent, or illegible. For instance, while the front view 300, shown in FIG. 3, of such an electrophoretic display is legible, the rear view 400, shown in FIG. 4, is not. The blocking function of the thin film transistor 203 and capacitor 204 effectively causes the contrast ratio—i.e. the ratio of the luminosity of the brightest and the darkest color on the display—of the rear view to be insufficiently large so as to be legible by a user. The present invention resolves this problem in at least one region of the display such that that region of the display offers a contrast ratio of sufficient magnitude as to be viewable from both sides of the display.

Figure 5:
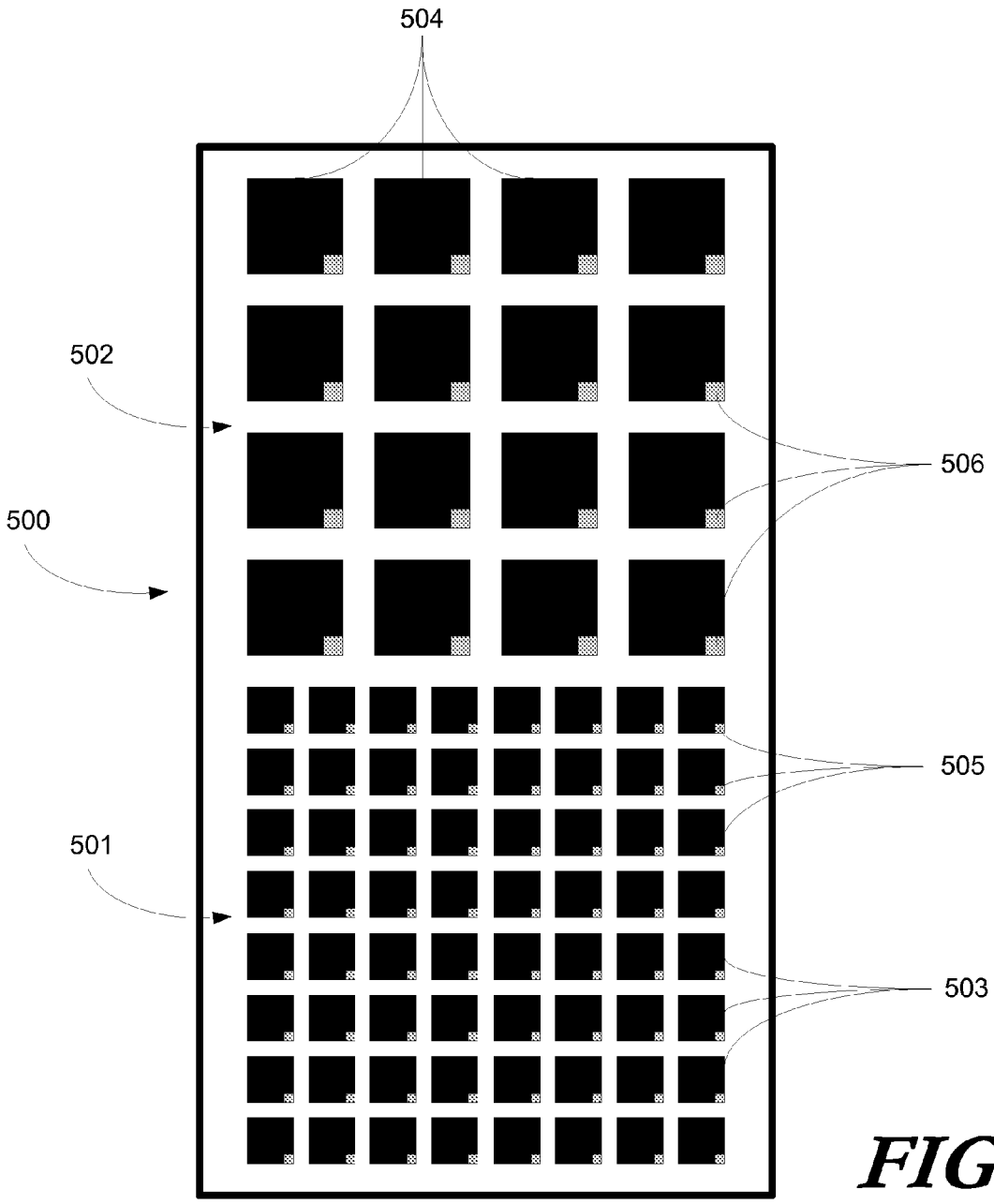
FIG. 5 illustrates one embodiment of a front, plan view of an electrophoretic display having a first region and a second region, wherein pixels in the first region are larger than pixels in the second region, in accordance with embodiments of the invention.

Turning now to FIG. 5, illustrated therein is one embodiment of an electrophoretic display 500 in accordance with one embodiment of the invention. The display 500 includes a first region 501 and a second region 502. Both the first region 501 and the second region 502 include selectively operable elements or members, referred to herein as "pixels."

So as to be visible from both sides of the display, pixels 504 in the second region 502 are larger than are pixels 503 in the first region 501. Said slightly differently, a member size, i.e. a pixel, associated with the first region 501 is at least two times smaller than a member size associated with the second region 502. As the pixels 504 in the second region 502 are configured to be driven by thin film transistors and capacitors, indicated collectively with reference designator 506, that have the same area as the thin film capacitors and transistors 505 of the first region 501, the aperture ratio of the pixels 504 in the second region 502 is greater than the aperture ratio of the pixels 503 in the first region 501. In one embodiment, the aperture ratio of the pixels 504 in the second region 502 is at least 80%. The increased aperture ratio translates into an overall contrast ratio in the second region 502, when viewed from the rear, that is sufficiently legible along the back side of the display 500.

The first region 501 may be referred to as a "high resolution" region, in that the pixels 503 are sufficiently small as to present easily viewable information to a user. The term "high resolution" is used herein to mean a display suitable for the presentation of text, information, and graphics with sufficient granularity as to be easily switched between graphics or text. For example, the high-resolution region would be one suitable for presenting an image in the Joint Photographics Expert Group (JPG) format to the user. One example of this would be a region having a 256 pixel by 128-pixel area.

The second region 502 may be referred to as a "low resolution" region because the pixels 504 are larger than those pixels 503 in the high-resolution region 501. In the embodiment of FIG. 5, the low-resolution region 502 comprises less selectively operable members—or pixels—per unit area than does the high-resolution region 501. The low resolution region 502 has sufficient granularity to present certain alphanumeric characters or icons to a user, by may not be suitable for presenting a photographic image. In one embodiment, the low-resolution region 502 includes pixels 504 that are at least twice as big as are the pixels 503 in the high-resolution region 501. Thus, a pixel aperture ratio associated with pixels 504 in the low-resolution region 502 is greater than a pixel aperture ratio associated with pixels 503 in the high-resolution region 501. As applications dictate, the pixels 504 in the low resolution region 502 may be four, eight, sixteen, or more times larger than the pixels 503 in the low resolution region 502. In one embodiment, the pixels 504 in the low-resolution region 502 are sufficiently large as to provide a contrast ratio—when viewed from the rear side of the display 500—of at least two to one.

Figure 6:
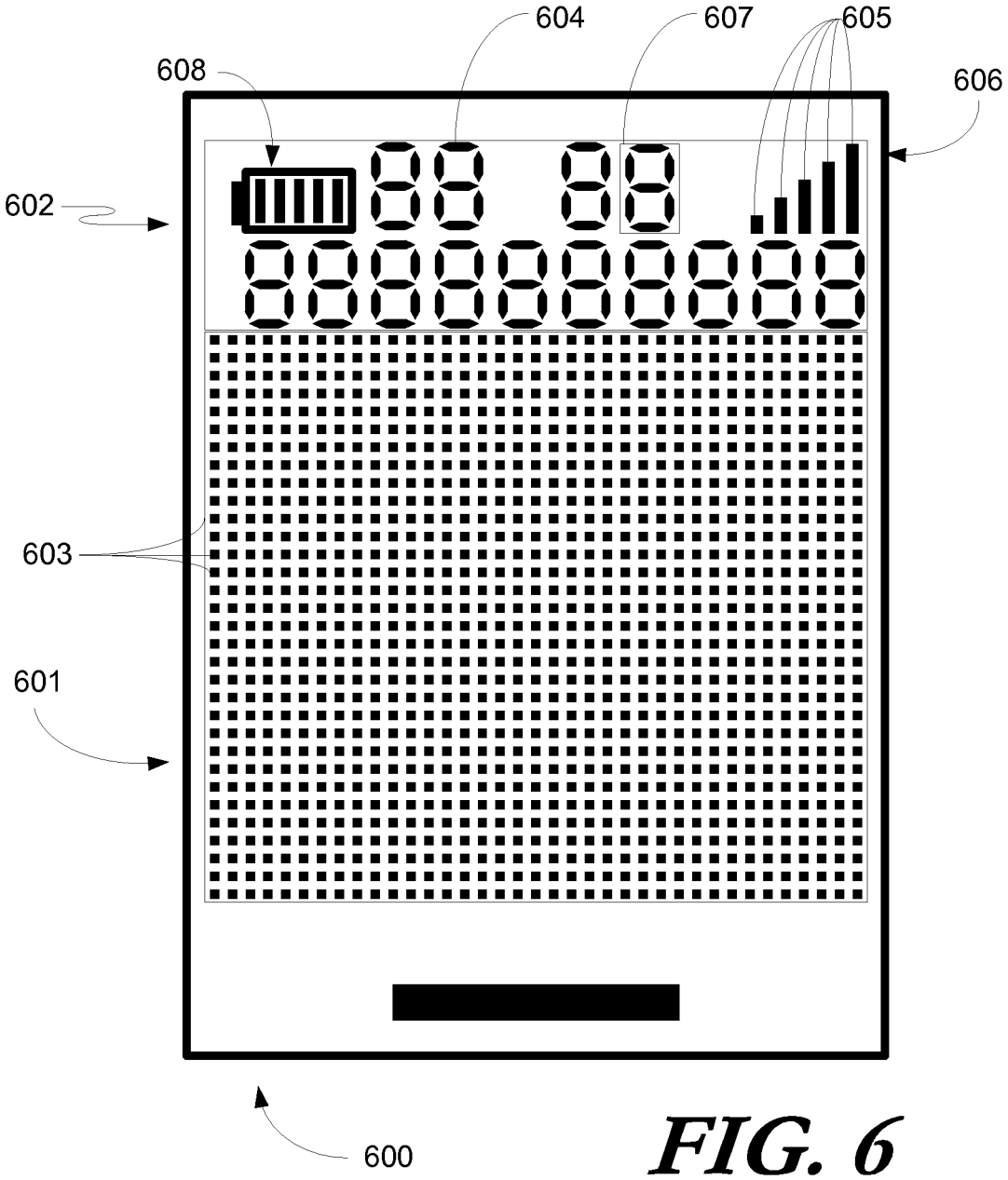
FIG. 6 illustrates another embodiment of a front, plan view of an electrophoretic display having a first region and a second region, wherein pixels in the first region are larger than pixels in the second region.

Turning now to FIG. 6, illustrated therein is an alternate embodiment of an electrophoretic display 600 in accordance with one embodiment of the invention. As with the embodiment of FIG. 5, the display 600 of FIG. 6 includes a first region 601 and a second region 602. Pixels 604 in the second region 602 are bigger than are pixels 603 in the first region 601. In one embodiment, the pixels in the second region 602 are at least two times bigger than are pixels 603 in the first region 601.

Unlike the embodiment of FIG. 5, where each of the pixels (503) in the first region (501) were geometrically uniform in shape, the pixels 604 in the second region 602 of FIG. 6 include at least some geometrically non-uniform members. For example, the bars 605 in the signal strength indicator 606 include bars of varying lengths that are non-geometrically uniform.

Another difference between the embodiment of FIG. 6 and the embodiment of FIG. 5 is that the embodiment of FIG. 6 includes pixels that are geometrically configured as specific shapes and symbols. For example, rather than being configured as a generic pixel, the elements in group 607 are configured as a character symbol. In the exemplary view of FIG. 6, the operable members of group 607 are configured as a seven-segment character. The operable members of group 608 are configured as an icon element, with each operable member being configured as at least a portion of an icon element. The exemplary icon element shown is that of a battery indicator. Indicator 606 is, as noted above, a signal strength indicator.

Figure 7:
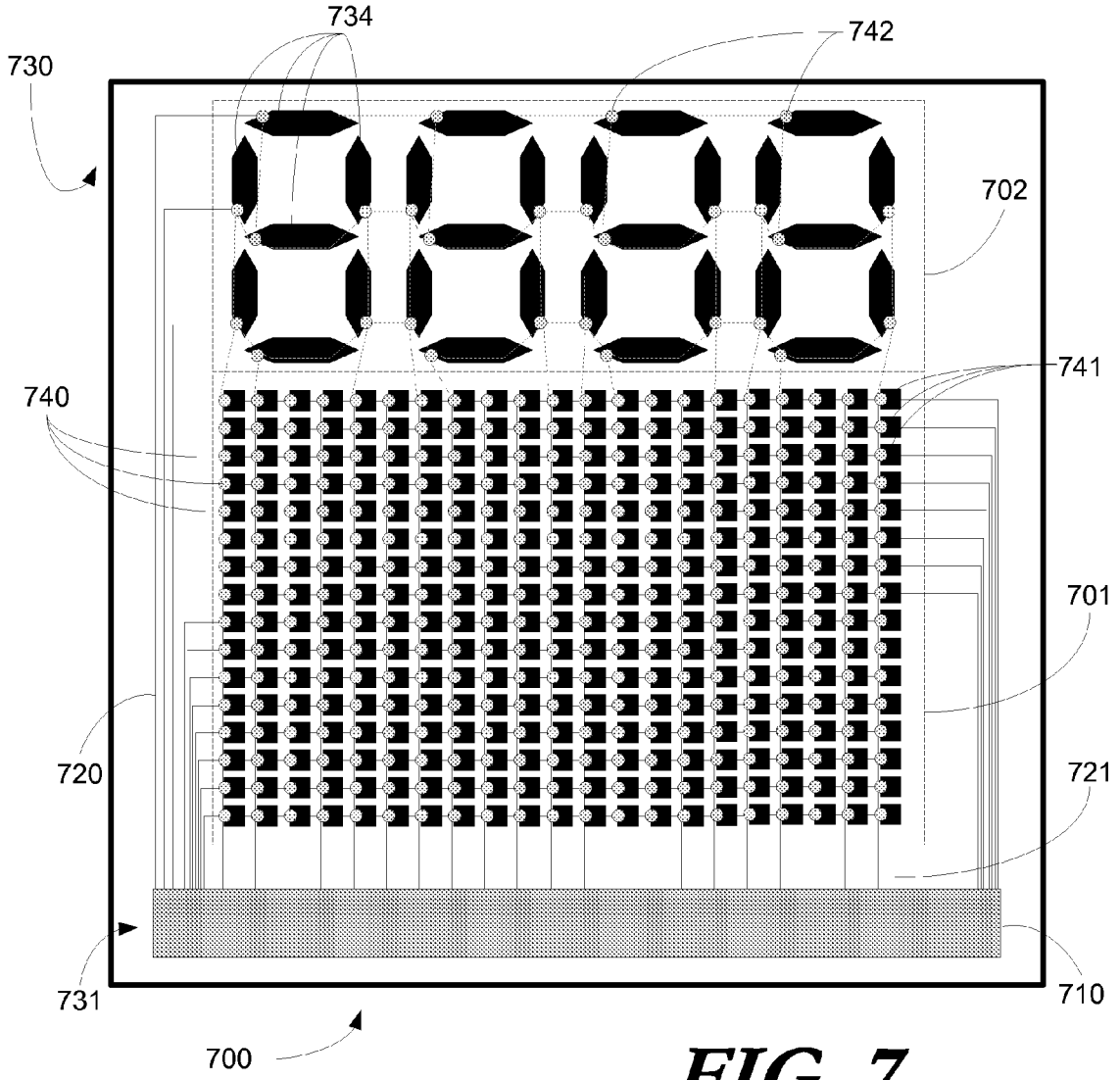
FIG. 7 illustrates a schematic block diagram of one embodiment of an electrophoretic display having front, a first region and a second region, wherein pixels in the first region are larger than pixels in the second region.

Turning now to FIG. 7, illustrated therein is a schematic block diagram of a display 700 including a high-resolution region 701 and a low-resolution region 702 in accordance with one embodiment of the invention. From the schematic block diagram of FIG. 7, the driver circuit 710 and various control lines may be seen.

The display 700, which is one element in a display assembly, is an electrophoretic display with the driver circuit 710 coupled thereto. As with the embodiments of FIGS. 5 and 6, the display 700 includes a high-resolution region 701 and a low-resolution region 702. Both the selectively operable members 703 of high-resolution region 701 and the selectively operable members 704 of the low-resolution region 702 may be selectively actuated, in one embodiment, by a common driver circuit 710. The driver circuit 710 controls each selectively operable member by a plurality of gate lines 720 and source lines 721 running between the selectively operable members and the driver circuit 710.

As with the embodiments of FIGS. 5 and 6, in the embodiment of FIG. 7 at least the second region 702 is visible from both a front side 730 and a rear side 731 of the electrophoretic display 700. Further, the selectively operable members 704 of the second region 702 are sufficiently large that a contrast ratio associated with the second region 702, as viewed from the rear side 731, is greater than a contrast ratio associated with the first region 701, as viewed from the rear side 731. The contrast ratio of the first region 701, when viewed from the rear side 731, is less due to the presence of capacitors and thin film transistors 741 that block visibility of the selectively operable members 703 in the first region 701.

The capacitors and thin film resistors 741 permit the driver circuit 710 to selectively operate each of the selectively operable members 703 in the first region. Each thin film transistor acts as a switch controlled by the driver circuit 710 to drive each of a corresponding selectively operable member. Each capacitor, which is disposed proximately and coupled with its corresponding selectively operable member, provides drive energy to cause the particles in the display to move electrophoretically. Similarly, capacitors and thin film resistors 741 in the second region 702 permit the driver circuit 710 to selectively operate each of the selectively operable members 704 in the second region 702.

Each of these capacitors and thin film transistors 741,742 are disposed on the transparent substrate—i.e. a thin film transistor substrate—forming the back side of the display assembly. This substrate is sometimes referred to herein as the "thin film transistor backplane." As can be seen from the view of FIG. 7, since the selectively operable members 704 of the second region 702 are larger in size than are the selectively operable members 703 of the first region 701, there are fewer selectively operable members 704 in the second region 702 than are in the first region 701. Thus, the second region 702 further includes less thin film transistors and capacitors 742 per unit area than does the first region 701.

While the sizes of the selectively operable members are different between the first region 701 and the second region 702, the physical size of the thin film transistors and capacitors in the first region 701 and second region 702 is roughly identical. In one embodiment, the size of the selectively operable members 704 in the second region 702 is at least twice that of the selectively operable members 703 in the first region 701. This means that a ratio of a visible surface area of each of the selectively operable members 704 in the second region 702 to a surface area of both the corresponding thin film transistor capacitor is at least two times greater in the second region 702 than in the first region 701. This translates into a contrast ratio in the second region 702 that is sufficiently legible to a user.

Figure 8:
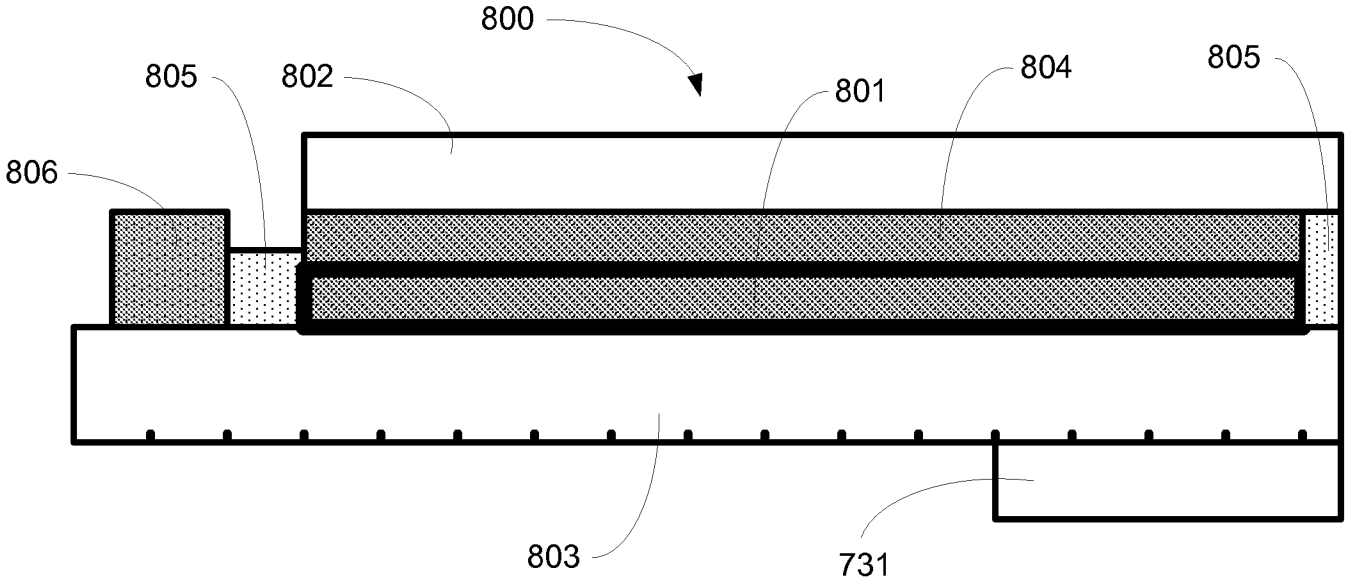
FIG. 8 illustrates a side, sectional view of a dual-sided electrophoretic display in accordance with embodiments of the invention.

Turning now to FIG. 8, illustrated therein is a sectional side view of one embodiment of a dual sided electrophoretic display structure 800 in accordance with the invention. This exemplary display structure 800 is suitable for use in an electronic device having display windows on opposite sides of a device housing.

In the exemplary embodiment of FIG. 8, the display structure 800 first includes an electrophoretic display film 801, which is disposed between an optional light guide 802 and a thin film transistor backplane 803. The thin film transistor backplane 803 may be manufactured from any rigid, transparent material, but are preferably manufactured from rigid plastic or reinforced glass. The optional light guide 802 is frequently manufactured from rigid plastic, but may also be constructed as a thin film assembly.

The optional light guide 802 acts to direct incident light to the electrophoretic film 801 and then back to the user's eye. A light guide is a substrate material that has refractive properties that direct light generally in a predetermined manner. Thus, when a ray of incident light passes through the optional light guide 802, it may travel generally towards the display so as to be reflected back to the user's eye with little dispersion or refraction. The light guide 802 is optional in that while it enhances performance, it is not required for the display 800 to function properly.

The thin film transistor backplane 803 is a hybrid or multifunction substrate, in that it both acts as an electrode layer for the particles in the electrophoretic film 801 and as a thin film transistor and/or capacitor substrate. Upon this thin film transistor backplane 803 are deposited the thin film transistors used by the driver circuit 710 to drive the various selectively operable members. The capacitors used to maintain a potential required for driving the particles in the electrophoretic film 801. Further, the indium tin oxide electrodes used to apply the electric field to the particles in the electrophoretic film 801 may also be disposed on the thin film transistor backplane 803.

An optional moisture barrier layer 804 may be optionally included between an outer substrate, e.g. substrate 802, and the electrophoretic film 801. This moisture barrier layer 804 helps to prevent foreign moisture from damaging the electrochemical properties of the electrophoretic film 801. The moisture barrier layer 804 may also provide ultraviolet protection for the electrophoretic film 801. The ends of the display structure 800 may be sealed with adhesive 805 to form a sealed chamber.

In addition to providing mechanical support for electrical components, such as thin film transistors, capacitors, and indium tin oxide electrodes, the thin film transistor backplane 803 may be used to provide support for other elements as well. For instance, in FIG. 8, the driver circuit 806 has been coupled to substrate 803 to form an integrated display assembly that includes both the display and the driver circuit 710. Additionally, mechanical supports, additional light guide sections, and alignment devices, e.g. light guide section 731, may be disposed on the substrates to assist with integration or operation of the display structure 800 in an overall electronic device.

Figure 9:
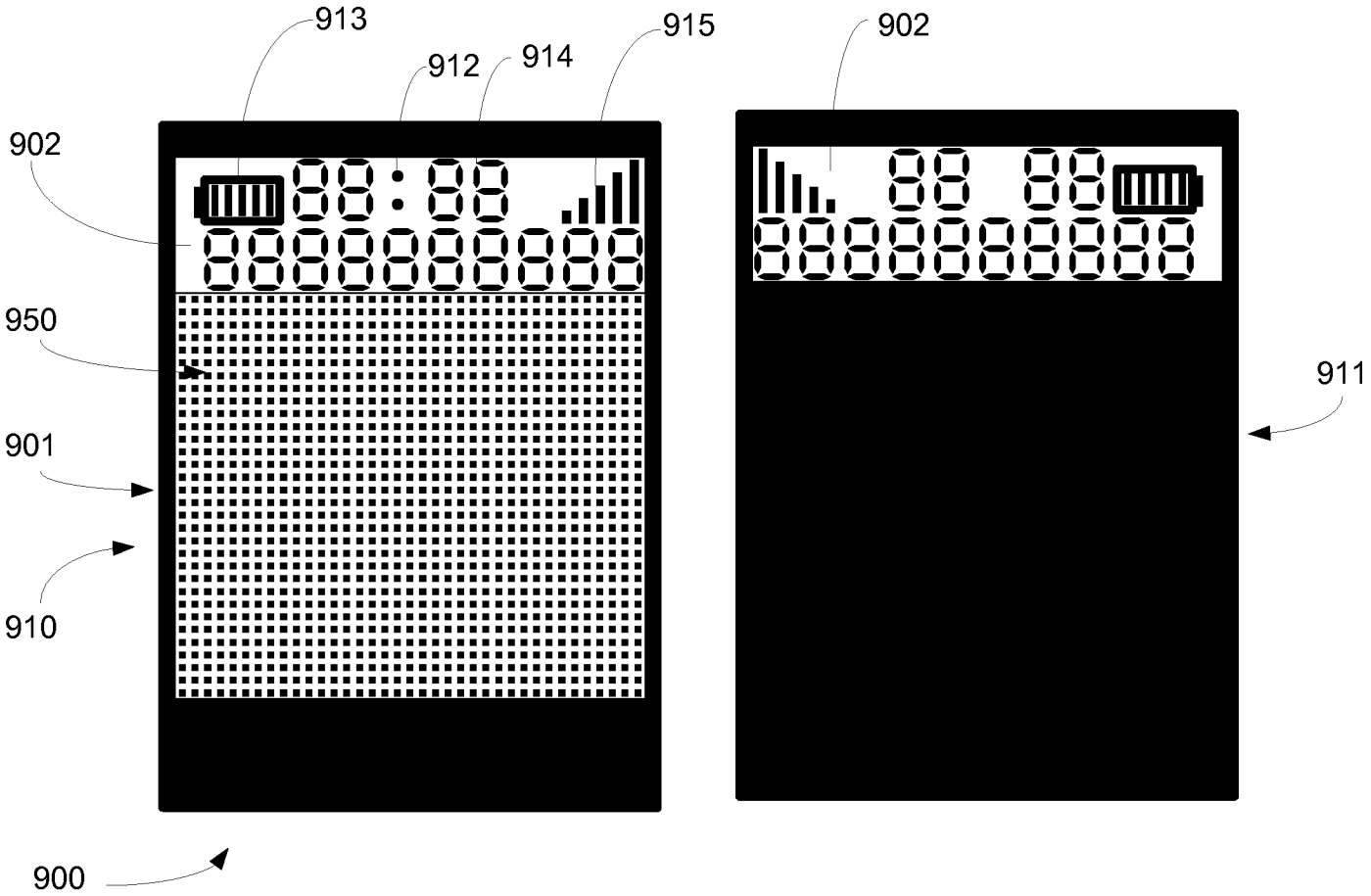
FIG. 9 illustrates a front and back view of one embodiment of an electrophoretic display in accordance with embodiments of the invention.

Turning now to FIG. 9, illustrated therein is a front view 910 and a rear view 911 of one embodiment of a dual sided display 900 in accordance with one embodiment of the invention. In this exemplary embodiment, the first region 901 displays a matrix grid 950 by selective operation of the selectively operable members. The matrix grid 950 is visible to a user on in the front view 910. However, on the rear view 911, the matrix grid 950 is not visible due to the aperture ratio of the selectively operable members in the first region 901 on the rear side of the display 900. The non-translucent thin film transistors and capacitors used to drive each of the selectively operable members cover a significant portion of each of the selectively operable members. This causes the aperture ratio of each to decrease. From the rear view 911, this translates to a contrast ratio that is insufficient for a user to legible view the matrix grid 950 from the rear side.

Turning to the second region 902, it has been configured such that the larger selectively operable members present icons 912,913, characters 914, and symbols. For instance, where the display 900 is to be used as a display for a mobile telephone, the second region 902 may include a battery status indicator 913, a signal strength indicator 913, seven segment alphanumeric characters 914, and associated symbols 915.

Figure 10:
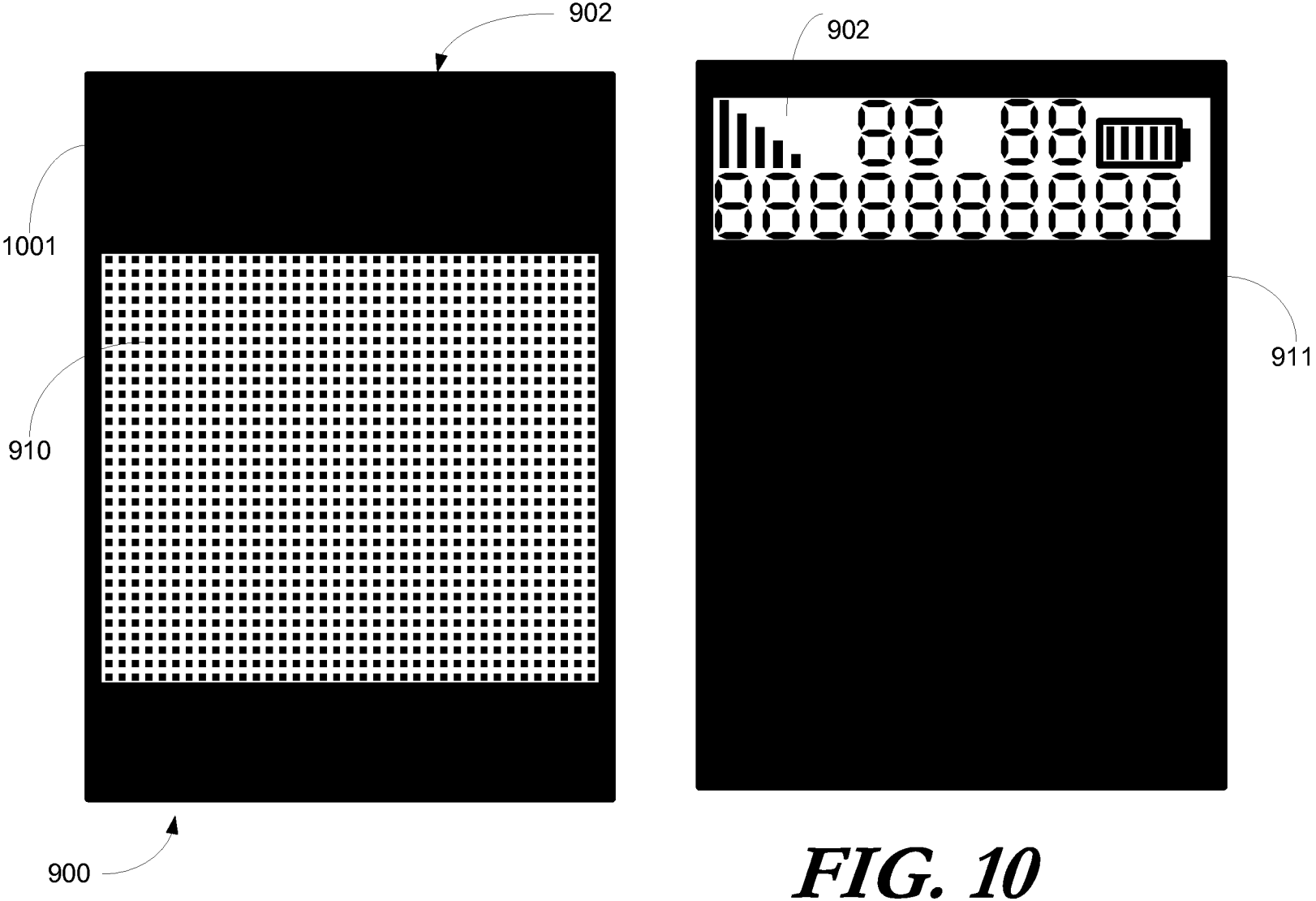
FIG. 10 illustrates a front and back view of one embodiment of an electrophoretic display in accordance with embodiments of the invention, where a shield covers one region.

Turning to the second region 902 in the rear view 911, each of these icons, symbols and characters is legibly visible, as the contrast ratio in the second region is improved by the relative size of the selectively operable members compared to their corresponding thin film transistors and capacitors. As such, each of the characters, icons, and symbols are legible, although each is presented as a mirror image of that of the front view 910.

Where the device in which the display 900 is used is a mobile telephone, the second region may be configured such that a positive image is displayed when viewed from the rear view 911. In such a scenario, a reversed, mirror image becomes visible from the front view 910. While some device designers may not mind this mirror image, others may. Turning now to FIG. 10, illustrated therein is one embodiment of a device assembly that eliminates the mirror image.

In the embodiment of FIG. 10, an opaque shield 1001 has been placed on the front side of the display 900. Thus, from the front view 910, the mirror image in the second region 902 is not visible. However, from the rear view 911, the second region 902 is visible. Said differently, the shield 1001 is disposed atop at least a portion of the second region 902 such that at least some of the second region 902 is not visible from the front view 910. Thus, if the display 900 were used in a device having a first window through which the front view 910 were visible, at least a portion of the second region 902 would not be visible through the first window.

Figure 11:
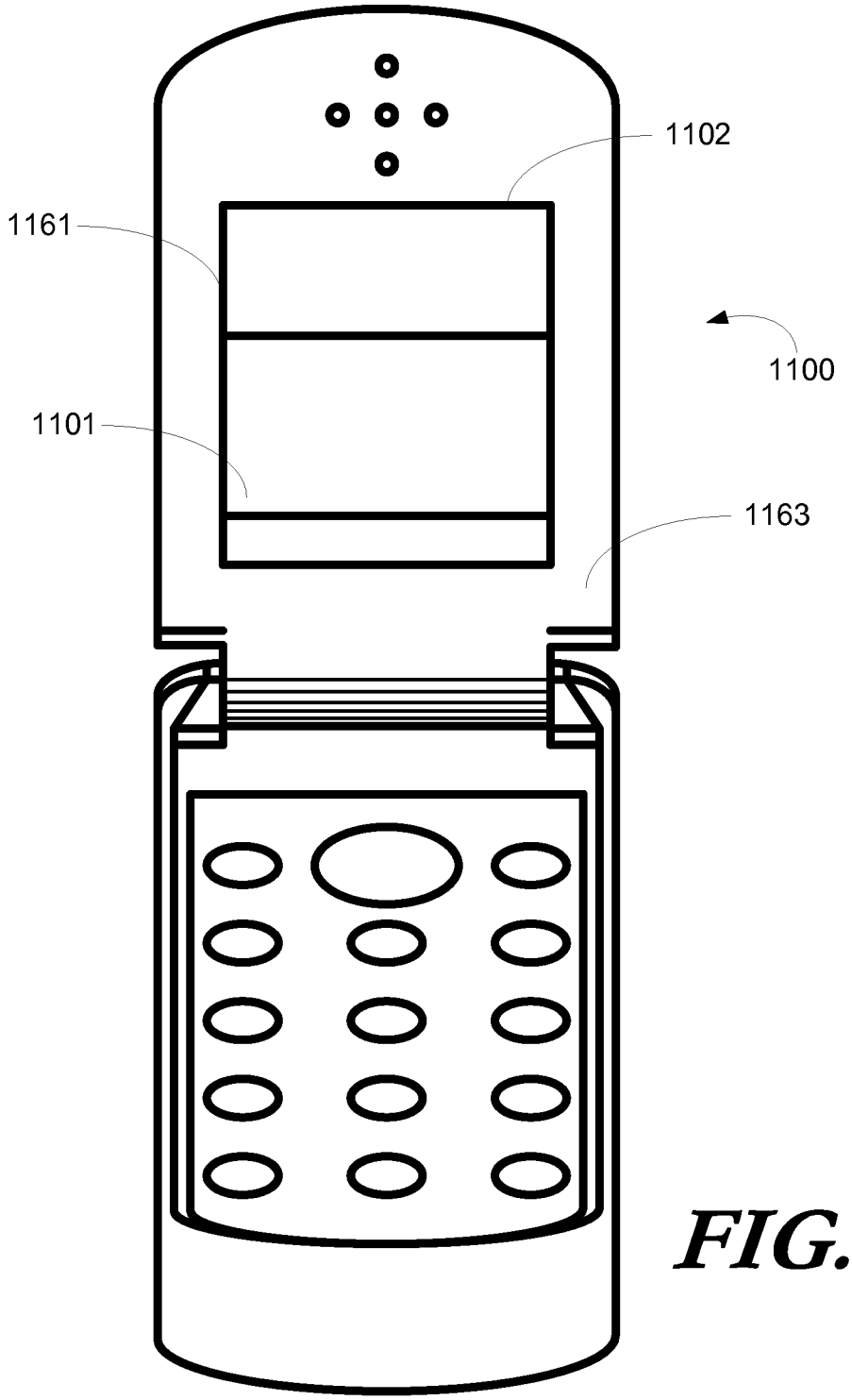
FIGS. 11 and 12 illustrate a portable electronic device having multiple displays employing an electrophoretic display in accordance with embodiments of the invention.
Figure 12:
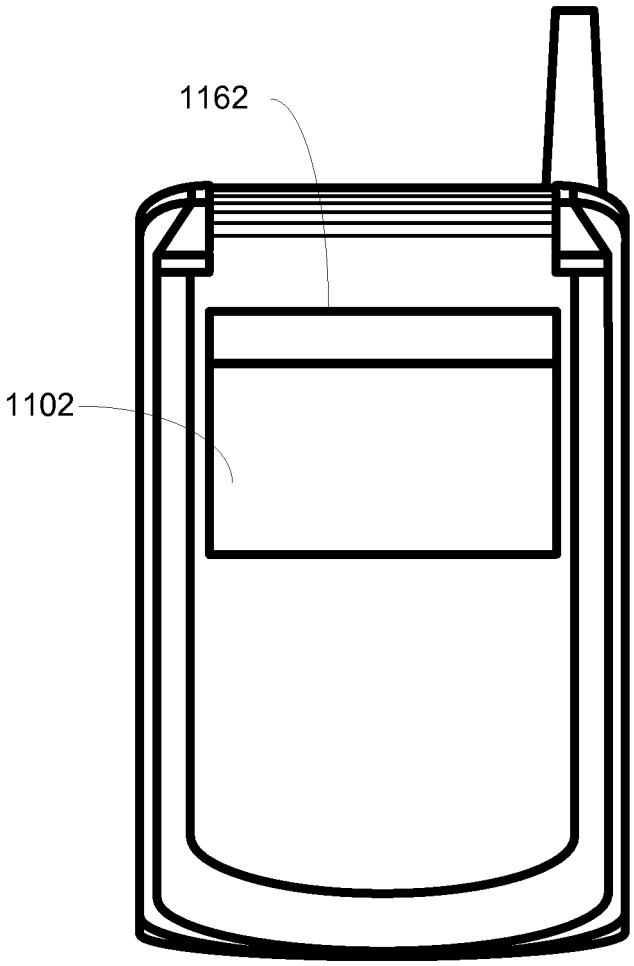

Turning now to FIGS. 11 and 12, illustrated therein is such a device. Specifically, the exemplary embodiment of FIGS. 11 and 12 illustrates a portable electronic device 1100 that has a multi-windowed housing 1163 and employs a dual-sided electrophoretic display in accordance with embodiments of the invention. The dual-sided electrophoretic display has a first region 1101 that is visible through a first window 1161. A second region 1102 of the dual-sided electrophoretic display is visible through at least the first window 1161 and a second window 1162. Each region 1101,1102 includes selectively operable electrophoretic members that are selectively operable by a driver circuit. In one embodiment the driver circuit is common to both the members of the first region 1101 and the members of the second region 1102.

In one embodiment, the windows 1161,1162 are covered with substantially transparent lenses to keep out dust, dirt and debris. The multi-windowed housing 1163, in one embodiment, includes a movable portion, wherein the second window 1162 is visible when the multi-windowed housing 1163 is closed. When the multi-windowed housing 1163 is open, both the first window 1161 and the second window 1162 are visible, with the first window 1161 visible on the one side of the multi-windowed housing 1163 and the second window 1162 visible on the second side of the multi-windowed housing 1163. Although the display is shown in a movable flip housing portion in the illustrative embodiment of FIGS. 11 and 12, it will be clear to those of ordinary skill in the art having the benefit of this disclosure that dual sided displays in accordance with embodiments of the invention could also be incorporated into a suitably thin electronic device having a one-piece housing.

As previously discussed, in one embodiment the contrast ratio, when viewed from the second side of the electrophoretic display, is at least two to one. Thus, in the embodiment of FIGS. 11 and 12, the contrast ratio, as viewed through the second window 1162, is also at least two to one.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims. Accordingly, the specification and figures are to be regarded in an illustrative rather than a restrictive sense, and all such modifications are intended to be included within the scope of present invention.

What is claimed is:

1. A display assembly for use in an electronic device, the display assembly comprising an electrophoretic display and a driver circuit coupled thereto, wherein the electrophoretic display comprises at least a first region and a second region, wherein at least the second region is visible from both a front side and a rear side of the electrophoretic display, further wherein a contrast ratio associated with the second region, as viewed from the rear side, is greater than a contrast ratio associated with the first region, as viewed from the rear side.

2. The display assembly of claim 1, wherein the contrast ratio associated with the second region, as viewed from the rear side, is at least two to one.

3. The display assembly of claim 1, wherein a pixel aperture ratio associated with pixels in the second region is greater than a pixel aperture ratio associated with pixels in the first region.

4. The display assembly of claim 1, wherein both the first region and the second region comprise selectively operable elements, wherein a selectively operable element in the first region is smaller than a selectively operable element in the second region.

5. The display assembly of claim 4, wherein the driver circuit is configured to selectively operate each of the selectively operable elements by a plurality of thin film transistors disposed upon a transparent substrate, wherein the second region comprises less thin film transistors per unit area than the first region.

6. The display assembly of claim 1, wherein the driver circuit is common to both the first region and the second region.

* * * * *